US012055340B2

(12) United States Patent
Pagnozzi et al.

(10) Patent No.: US 12,055,340 B2
(45) Date of Patent: Aug. 6, 2024

(54) ENDCAP ASSEMBLY FOR A DOOR OF A REFRIGERATION APPLIANCE

(71) Applicant: ELECTROLUX DO BRASIL S.A., Curitiba (BR)

(72) Inventors: Rodrigo Marge Pagnozzi, Curitiba (BR); Aguilar Da Silva, Curitiba (BR); Alexandre Sauer, Curitiba (BR); Alcione Colecha, Curitiba (BR); Guilherme Rissatto Picanço, Curitiba (BR); Israel Mercer Neto, Curitiba (BR); Augusto Biscaia Da Silva, Curitiba (BR)

(73) Assignee: Electroux do Brasil S. A., Curitiba (BR)

( * ) Notice: Subject to any disclaimer, the term of this patent is extended or adjusted under 35 U.S.C. 154(b) by 66 days.

(21) Appl. No.: 17/791,699

(22) PCT Filed: Jan. 17, 2020

(86) PCT No.: PCT/BR2020/050007

§ 371 (c)(1),
(2) Date: Jul. 8, 2022

(87) PCT Pub. No.: WO2021/142519

PCT Pub. Date: Jul. 22, 2021

(65) Prior Publication Data

US 2023/0032877 A1 Feb. 2, 2023

(51) Int. Cl.
*F25D 23/02* (2006.01)

(52) U.S. Cl.
CPC ..... *F25D 23/028* (2013.01); *F25D 23/02* (2013.01)

(58) Field of Classification Search
CPC .... F25D 23/028; F25D 23/02; F25D 2400/18; A47B 96/201; A47B 96/20
See application file for complete search history.

(56) References Cited

U.S. PATENT DOCUMENTS 7,866,773 B2 1/2011 Leimkuehler et al.
7,886,500 B2 2/2011 Leimkuehler et al.
(Continued)

FOREIGN PATENT DOCUMENTS

BR PI0902918 5/2011
KR 20180022235 3/2018

OTHER PUBLICATIONS

International Search Report for PCT/BR2020/050007 dated May 28, 2020, 1 page.
(Continued)

*Primary Examiner* — Justin B Rephann
(74) *Attorney, Agent, or Firm* — Pearne & Gordon LLP

(57) ABSTRACT

A refrigeration appliance includes a compartment for storing food items in a refrigerated environment, and having a door for selectively closing the compartment. The door includes a front panel, a rear panel, and an endcap assembly disposed therebetween at a vertical end thereof. The endcap assembly defines a handle for allowing grip of the door to thereby selectively open and close the door. The endcap assembly includes a plurality of discrete, spaced-apart snap elements along a generally front portion thereof for clamping a distal end of the front panel at a generally vertical extent of the front panel. The endcap assembly and front panel are configured to be maintained aside one another rather than extending therethrough, with the endcap assembly further configured to provide an elastic clamping force to the distal end of the front panel.

20 Claims, 17 Drawing Sheets

(56) References Cited

U.S. PATENT DOCUMENTS

| | | | | |
|---|---|---|---|---|
| 9,702,621 | B2 * | 7/2017 | Cho | F25D 29/005 |
| 10,012,426 | B2 | 7/2018 | Joo et al. | |
| 10,012,427 | B2 | 7/2018 | Cheon | |
| 10,018,218 | B2 | 7/2018 | Jung | |
| 10,145,603 | B2 | 12/2018 | Kim et al. | |
| 10,247,224 | B2 | 4/2019 | Jung | |
| 10,254,039 | B2 | 4/2019 | Joo et al. | |
| 10,995,978 | B2 * | 5/2021 | Lee | F25D 23/126 |
| 11,047,613 | B1 * | 6/2021 | Park | A47B 96/201 |
| 11,073,326 | B2 * | 7/2021 | Raab | F25D 23/028 |
| 11,402,147 | B2 * | 8/2022 | Lee | F25D 23/02 |
| 2006/0265960 | A1 * | 11/2006 | Leimkuehler | F25D 23/02 49/501 |
| 2013/0334951 | A1 * | 12/2013 | Allard | H05K 5/0247 312/405 |
| 2016/0209110 | A1 * | 7/2016 | Cho | F25D 23/062 |
| 2016/0341468 | A1 | 11/2016 | Joo et al. | |
| 2017/0082349 | A1 * | 3/2017 | Jung | F25D 23/028 |
| 2017/0370631 | A1 | 12/2017 | Kim et al. | |
| 2018/0087827 | A1 | 3/2018 | Lee et al. | |
| 2018/0283768 | A1 | 10/2018 | Raab et al. | |
| 2018/0292127 | A1 | 10/2018 | Park et al. | |

OTHER PUBLICATIONS

Brazilian Office action for BR112022014072-0 dated Apr. 15, 2024, 4 pages.

* cited by examiner

ENDCAP ASSEMBLY FOR A DOOR OF A REFRIGERATION APPLIANCE

FIELD OF THE INVENTION

This application relates generally to an endcap assembly for a vertically upper or lower end of a door of a refrigeration appliance, and more particularly to an intermediate member for use with an integrated handle and endcap construction on a door for a cooled food compartment of a refrigeration appliance.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored and the freezer compartment is where food items that are to be kept in a frozen condition are stored. The refrigerators are provided with a refrigeration system that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air.

Many modern refrigerators use a pair of French-type doors wherein two opposing doors allow access to the fresh food compartment. Some refrigerators are designed such that said refrigerator doors present a symmetrical configuration (i.e., the two opposing doors having the same width), while other are designed such that said refrigerator doors present an asymmetrical configuration (i.e., the two opposing doors have different widths).

In either configuration, each door includes a handle for allowing opening of the door. The handle can be attached to a front door panel, side door panel, etc., or can be recessed or integrated into an aspect of the respective door, such as into an endcap at a vertical end of the respective door.

Additionally, each door conventionally consists of at least a front panel, a rear panel, upper and lower endcap assemblies including respective endcaps. In some cases, an interior of the door between these panels and endcap assemblies can be insulated, such as being filled with insulation. The insulation typically is fluidly injected, such as foamed, into the insulation space after assembly of the panels and endcap assemblies to one another. The insulation often extends along the entire door to thereby provide a full barrier to the transmission of heat so that the efficiency of the refrigeration appliance is increased and undesirable localized zones of condensation do not develop. The insulation also can aid in retaining these components in their joint assembled state.

BRIEF SUMMARY OF THE INVENTION

The following presents a simplified summary of the disclosure in order to provide a basic understanding of some example aspects described in the detailed description. This summary is not an extensive overview. Moreover, this summary is not intended to identify critical elements of the disclosure nor delineate the scope of the disclosure. The sole purpose of the summary is to present some concepts in simplified form as a prelude to the more detailed description that is presented later.

According to one aspect, a door for sealing an internal compartment of a refrigeration appliance includes a front panel defining an exterior front surface of the door, an endcap defining a handle for allowing grip of the door and providing closure for a vertical end of the door, and an intermediate member disposed between the endcap and the front panel and that secures the endcap to the front panel. The intermediate member extends along an upper vertical extent of the front panel. The intermediate member has a plurality of discrete snap elements spaced-apart along the extent of the intermediate member for clamping a distal edge of the front panel. The endcap is configured to provide an elastically-applied clamping force to retain the intermediate member therewith and to retain the front panel at the intermediate member.

According to another aspect, a door for sealing an internal compartment of a refrigeration appliance includes a front panel and a rear panel, the front panel for defining a front surface and side portions of the door. The door further includes an endcap assembly extending between the front panel and the rear panel and sealing a vertically upper or lower end of the door. The endcap assembly includes an endcap defining a depression extending generally horizontally along a portion of the front surface of the front panel, and a generally U-shaped intermediate member having a central portion and a pair of oppositely disposed edge portions extending generally orthogonally rearward from opposite sides of the central portion and corresponding with a distal extent of the front panel. The intermediate member is disposed between and couples together the endcap and the front panel. The endcap has a concave extension that extends laterally along the front panel and wraps around the intermediate member to a front lip disposed at the central portion and adjacent a top surface of a bent portion at the distal end of the front panel that is bent out of plane from a front surface of the front panel.

According to yet another aspect, an endcap assembly for sealing and defining a vertical end of a compartment sealing-body of a refrigeration appliance includes an endcap having a depression defining a handle for a user, and an intermediate member securable between front and rear aspects of the endcap, the intermediate member for securing a front panel of the compartment sealing-body to the endcap. The intermediate member includes a generally-horizontal ledge, a plurality of discrete tabs extending from and forward over the generally-horizontal ledge, and a plurality of spaced-apart raised ribs at the generally-horizontal ledge, and a least a portion of the raised ribs being vertically disposed between the generally-horizontal ledge and the plurality of discrete tabs. The front aspects of the endcap include a concave extent receiving the plurality of discrete tabs therein and providing an elastic clamping force between the plurality of discrete tabs and plurality of spaced-apart raised ribs for clamping a distal edge of the front panel.

The foregoing and other features of the invention are hereinafter described in greater detail with reference to the accompany drawings.

BRIEF DESCRIPTION OF THE DRAWINGS

The accompanying drawings, which are not necessarily to scale, show various aspects of the disclosure.

DESCRIPTION OF EXAMPLE EMBODIMENTS

Figure 1:
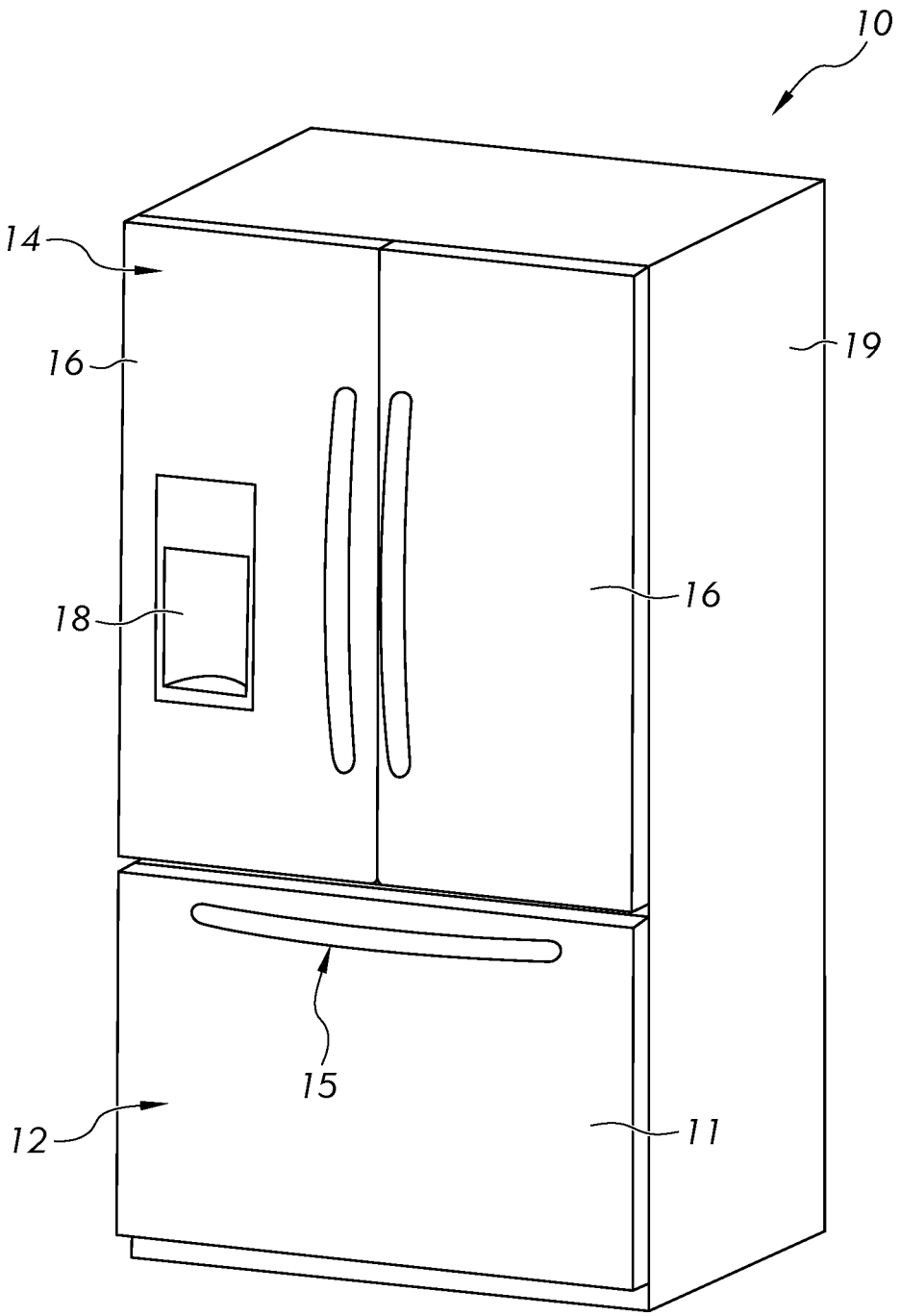
FIG. 1 is a front perspective view of a conventional household French door bottom mount refrigeration appliance showing doors of the fresh food compartment and drawer of a freezer compartment in a closed position.

Generally disclosed is a refrigeration appliance that includes a compartment for storing food items in a refrigerated environment, the compartment being selectively closed by a door that includes a front panel, a rear panel, and an endcap assembly disposed therebetween at a vertical end thereof. The endcap assembly defines a handle for allowing grip of the door to thereby selectively open and close the door. More particularly, the endcap assembly includes a plurality of discrete, spaced-apart snap elements along a generally front portion thereof for clamping a distal end of the front panel at a generally vertical extent of the front panel. The front panel and the endcap assembly are configured to be maintained aside one another rather than one extending therethrough the other, with the endcap assembly further configured to provide an elastic clamping force to the distal end of the front panel.

Embodiments of a refrigerator or a component thereof will now be described with reference to the accompanying drawings. Whenever possible, the same reference numerals are used throughout the drawings to refer to the same or like parts. However, this apparatus may be embodied in many different forms and should not be construed as limited to the embodiments set forth herein.

Referring now to the drawings, FIG. 1 shows a conventional refrigeration appliance in the form of a domestic refrigerator, indicated generally at 10. Although the detailed description that follows concerns a domestic refrigerator 10, the invention can be embodied by refrigeration appliances other than with a domestic refrigerator 10. Further, an embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

Figure 2:
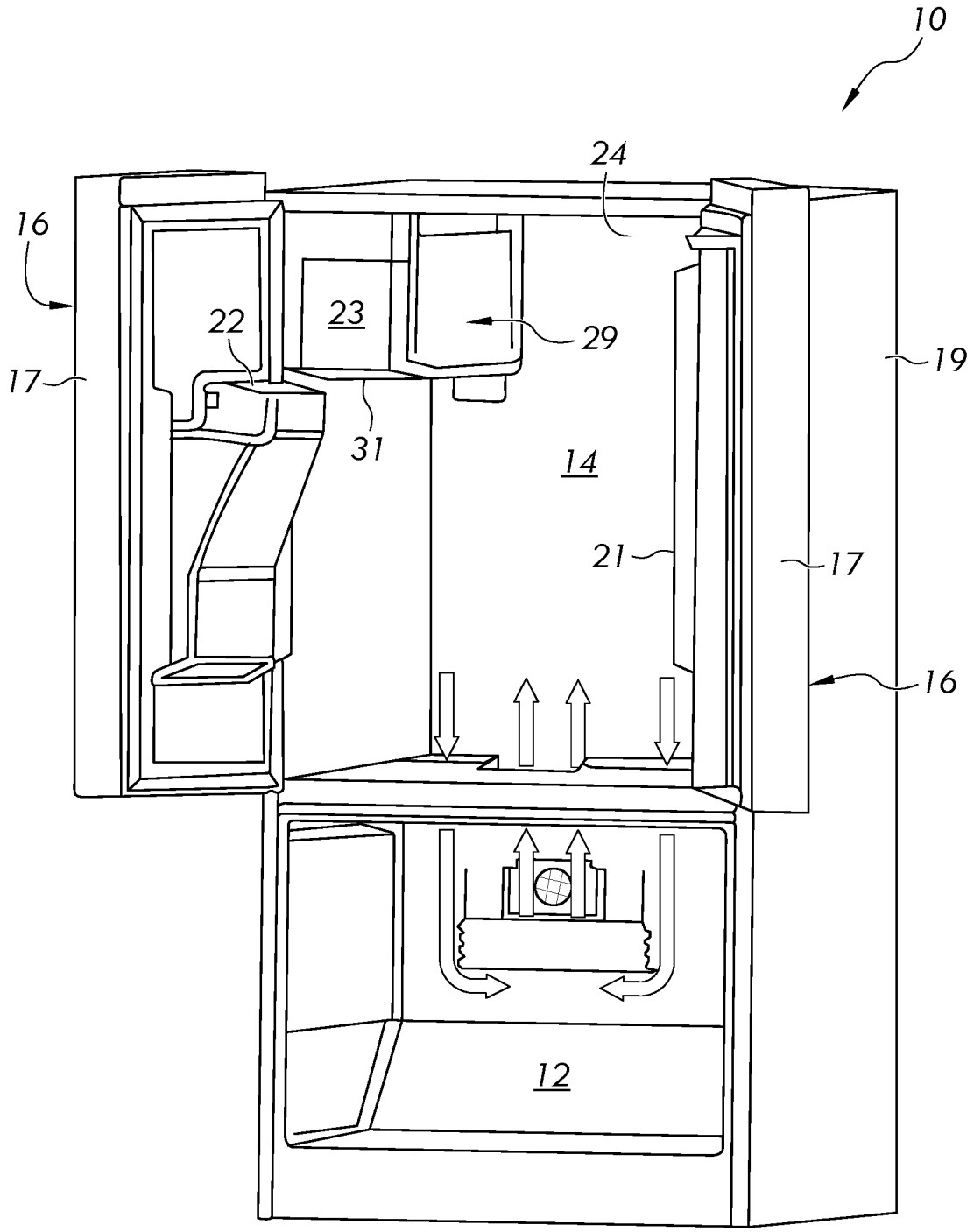
FIG. 2 is a front perspective view of the conventional refrigeration appliance of FIG. 1 showing the doors of the fresh food compartment and the drawer of the freezer compartment in an opened position.

One or more doors 16 shown in FIG. 1 are pivotably coupled to a cabinet 19 of the refrigerator 10 to restrict and grant access to the fresh food compartment 14. The door 16 can include a single door that spans the entire lateral distance across the entrance to the fresh food compartment 14, or can include a pair (i.e., two) of French-type doors 16 as shown in FIG. 1 that collectively span the entire lateral distance of the entrance to the fresh food compartment 14 to enclose the fresh food compartment 14. For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotably coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation, and forms an angle other than parallel relative to the door 16 when the center mullion 21 is in the second orientation. The seal and the externally-exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 23 (FIG. 2) of an ice maker 29 disposed within the fresh food compartment 14. Ice pieces from the ice bin 23 can exit the ice bin 23 through an aperture 31 and be delivered to the dispenser 18 via an ice chute 22 (FIG. 2), which extends at least partially through the door 16 between the dispenser 18 and the ice bin 54.

Referring to FIG. 1, the freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this aim by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 14 to maintain the temperature therein greater than 0° C. preferably between 0° ° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12.

According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
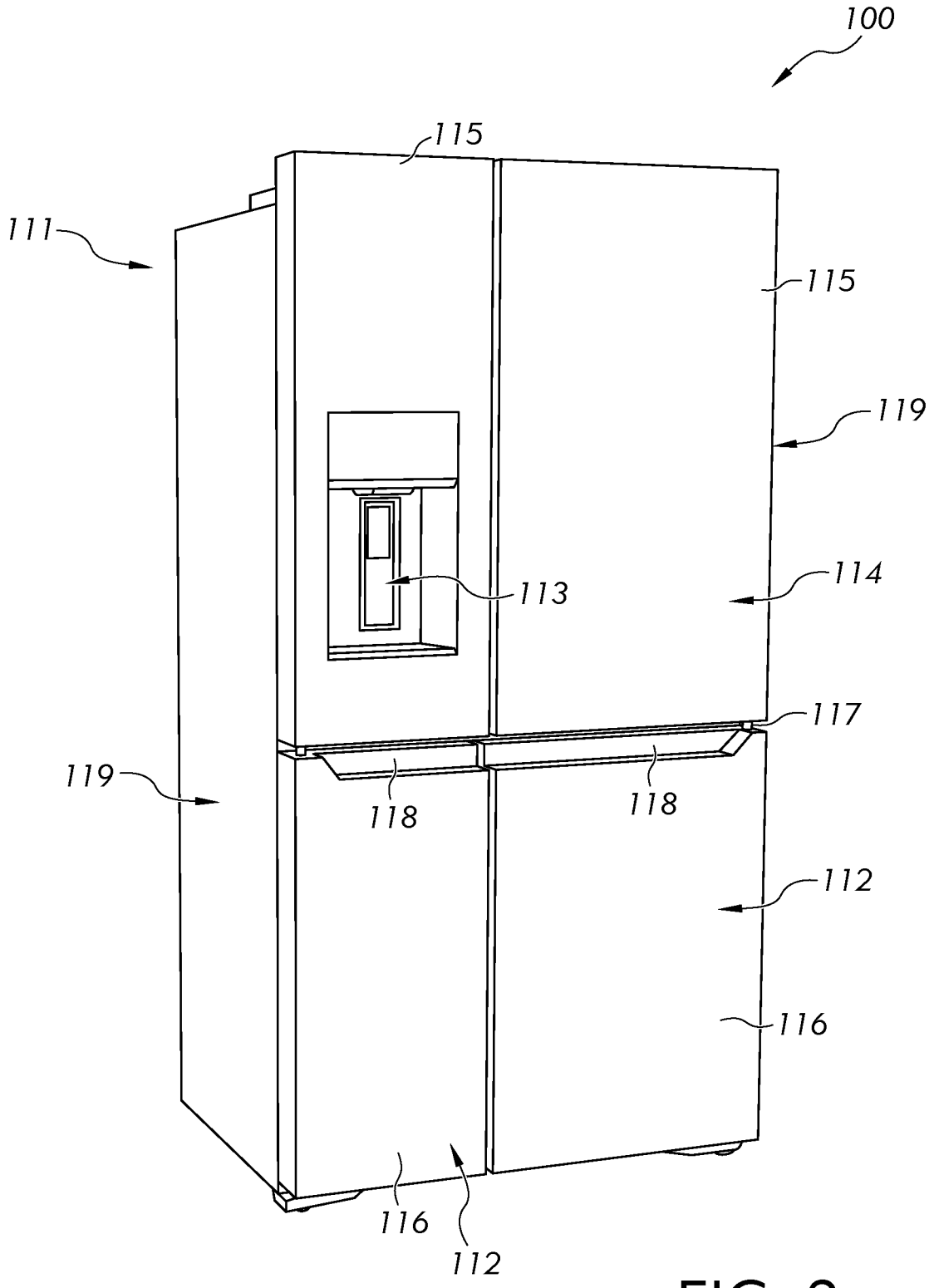
FIG. 3 is a front perspective view of an example refrigerator according to the present disclosure, the figure showing a four-door refrigeration appliance where the pair of bottom doors each include at least an upper endcap assembly according to the present disclosure.

Turning now to FIG. 3, another refrigerator 100, also herein referred to as a refrigeration appliance 100, is illustrated having four compartment sealing bodies, i.e., doors 116. The refrigerator 100 is substantially similar to the refrigerator 10 discussed above, and also has a bottom mount configuration, except that it has the bottom freezer compartment selectively closed by a pair of doors rather than a single drawer, and as otherwise discussed below. Optionally, one of the bottom doors can enclose a convertible compartment or variable climate zone (VCZ) that enables a user to selectively adjust the temperature between a fresh-food or a freezer compartment. Aspects of the refrigerator 100 that are similar to aspects of the refrigerator 10 are identified with the same reference numbers but indexed by 100. It will be appreciated that aspects of the refrigerator 10 may be incorporated into the refrigerator 100 and vice-versa.

The refrigerator 100 includes a body 111 providing an upper fresh food compartment 114 and one or more lower freezer compartment(s) 112, each compartment 112, 114 being selectively closed by a respective pair of upper doors 115 or lower doors 116. Preferably, an upper door 115 includes a dispenser 113, such as for ice, water or both. Preferably, a pair of freezer compartments 112 are separated from each other by a vertical mullion, such that each door 116 permits selective access to each individual freezer compartment. Optionally, at least one of the freezer compartments can be a convertible compartment or variable climate zone (VCZ) that provides a user-adjustable storage area whose temperature can be maintained at either the temperature associated with the fresh food compartment or that of the freezer compartment (or anywhere therebetween). That is, the temperature maintained in the VCZ compartment 106 is adjustable so as to accommodate a wide variety of food articles to be stored therein. In this case, the lower freezer compartment can be separated from the VCZ compartment by the vertical mullion, and the separate doors 116 can provide separate and individual access to either of the freezer or VCZ compartment. In the illustration of FIG. 3, the VCZ compartment is shown as the lower left compartment and the freezer is the lower right compartment, although this could be reversed.

The adjacent doors 116 closing the freezer compartment (s) 112 (or freezer and VCZ compartments) each are pivotably connectable by a hinge 117 to the body 111 of the refrigerator 100. These doors 116 each include a recessed handle 118 that does not extend beyond the front panels 120 of the doors 116. The handles 118 are integrated with the respective vertically-upper endcap assemblies of the doors 116. The handles 118 are shown as jointly providing a single handle cavity that extends between both doors 116, with an inner side of each handle 118, at an intermediate joinder of the doors 116 when closed, being open to the handle 118 of the other door 116. In other embodiments, each handle 118 may provide a cavity separated from a cavity of the adjacent side-by-side door, such as by a laterally-inner wall. As used herein, the lateral direction extends between opposite sides 119 of the body 111. As used herein, the terms, upper, vertical, horizontal, lower, etc. are made with reference to alignment of a typical refrigerator in an upright and ready-to-use position, as shown in FIG. 3.

Figure 4:
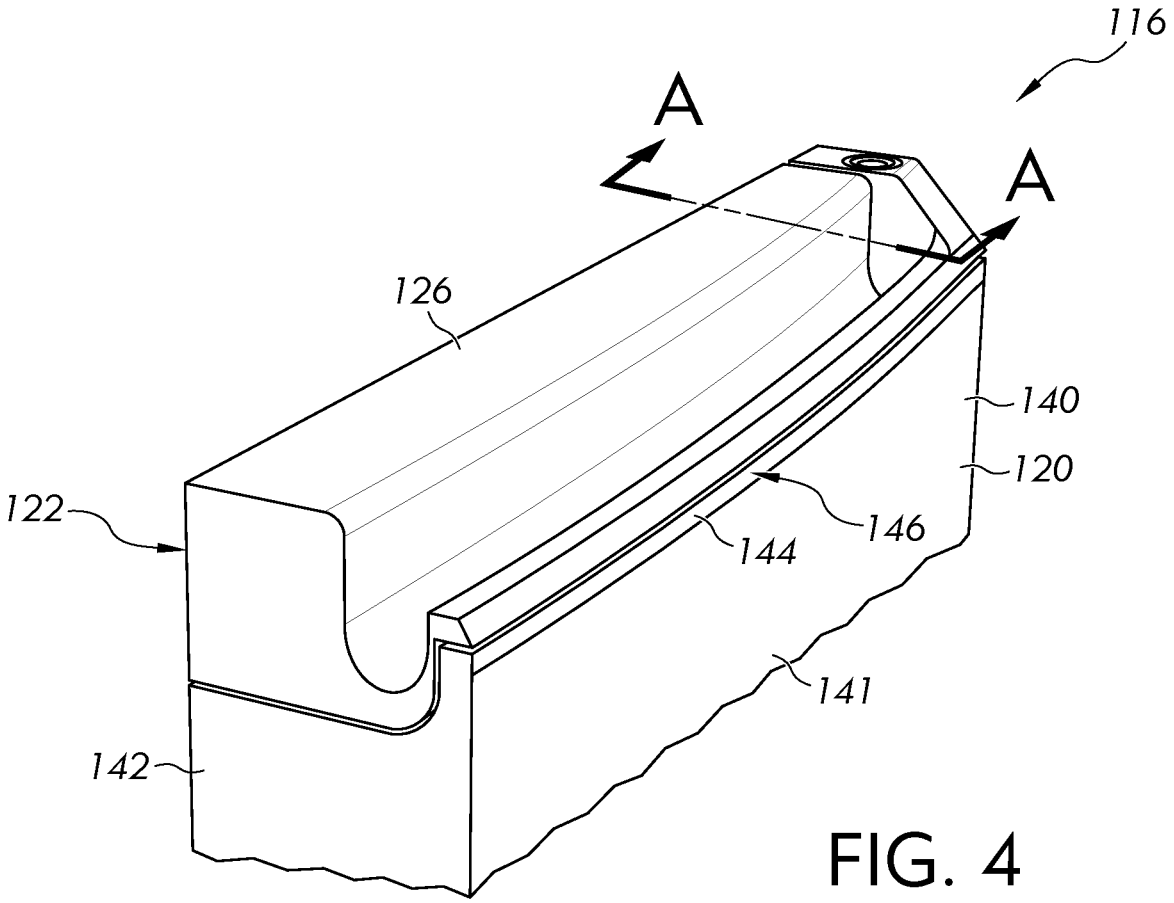
FIG. 4 is a top perspective view of the right bottom door of the refrigeration appliance of FIG. 3, with the front panel having a generally arched front face.
Figure 5:
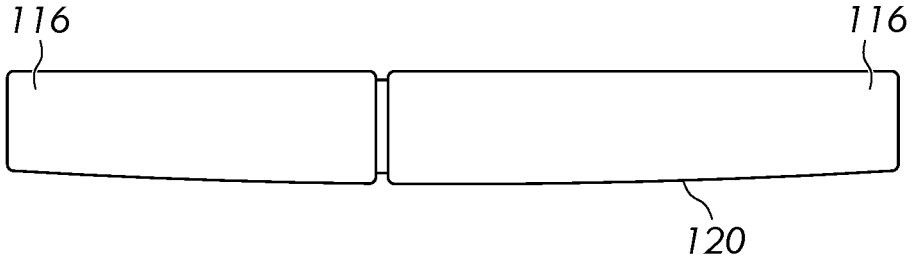
FIG. 5 is a schematic top view of the pair of bottom doors of FIG. 3 apart from the remainder of the refrigeration appliance.
Figure 6:
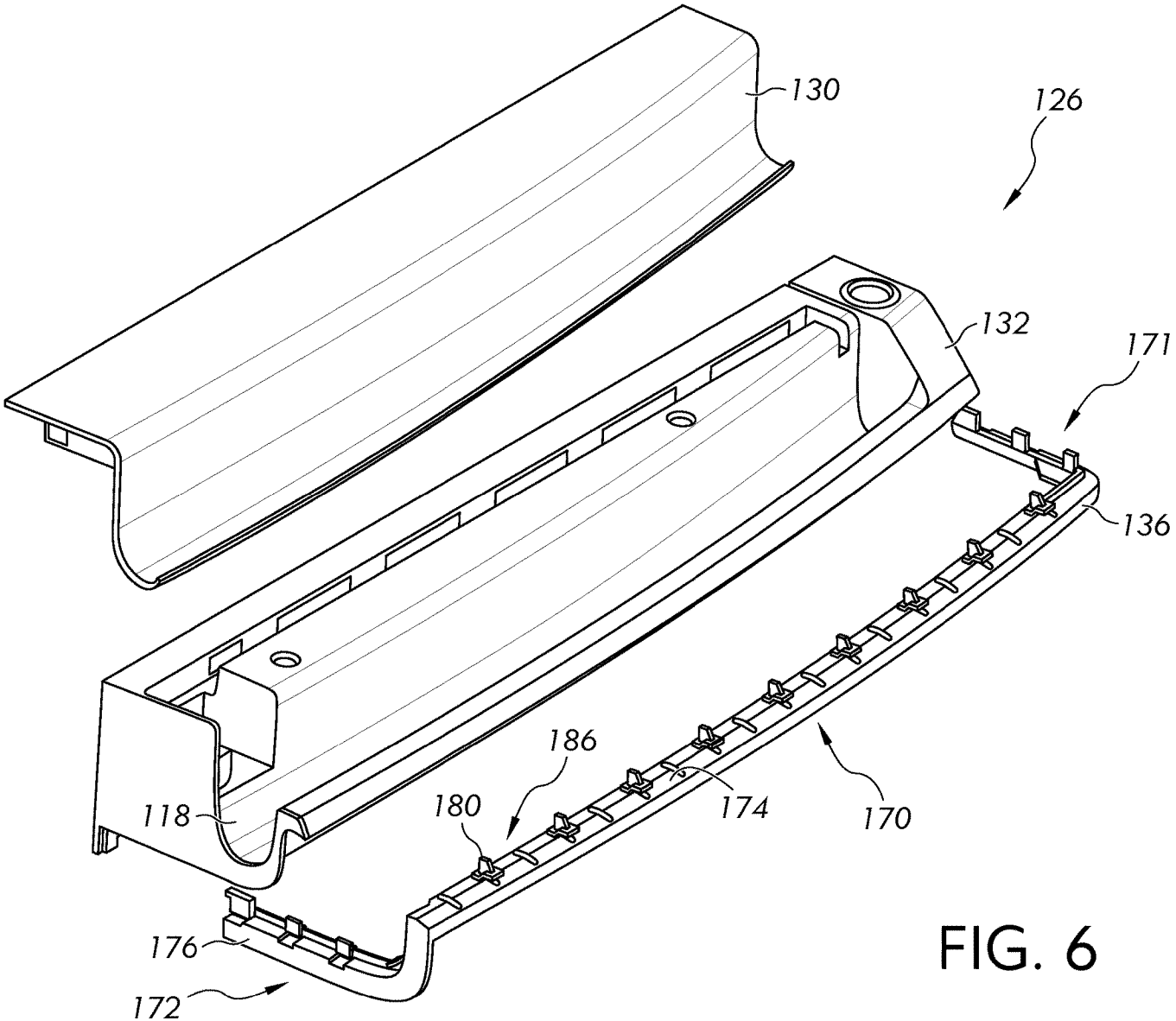
FIG. 6 is an exploded view of the endcap assembly depicted in FIG. 4.

Referring now to FIGS. 4 to 6, the lower right door 116 of the refrigeration 100 is shown separate from the remainder of the body 111. It can be appreciated that the lower left door 116 can be similar although in the reverse construction. The door 116 includes a front panel 120, a rear panel 122, a vertically-lower endcap assembly 124, and a vertically-upper endcap assembly 126. The endcap assemblies 124, 126 are disposed between the panels 120, 122 and close the upper and lower ends of the respective doors 116. The upper endcap assembly 126 is configured to provide an elastically-applied clamping force to retain the front panel 120 therewith, and specifically to maintain the endcap assembly 126 and the front panel 120 in a contiguous arrangement, such as absent one or the other extending therethrough the other.

The depicted front panel 120 provides the exterior front surface of the door 116, and as particularly illustrated at the schematic drawing of FIG. 5, said front surface has a generally arched profile. In other embodiments, the front panel 120 may have a flat front surface. The front panel 120 includes a front panel portion 140 having a front surface 141 and opposed side panel portions 142 extending therefrom towards the rear panel 122. The front panel 120 has an upper bent portion 144 defining a distal end 146 at the upper vertical extent of the front panel 120. The bent portion 144 is bent out of plane from the front surface 141 of the front panel portion 140. The illustrated front panel 120 is comprised of metal, such as steel or aluminum, although other materials can be suitable in other embodiments.

As shown at FIG. 6, the upper endcap assembly 126 includes a cover 130, an endcap 132 (also herein referred to as an endcap member) and an intermediate member 136 that, once assembled, is interposed between the endcap 132 and the front panel 120 of the door. In some embodiments door 116 is internally-foamed (i.e., with an expanding insulating foam) to aid in retaining the endcap 132 and front panel 120 in position relative to one another.

Figure 7:
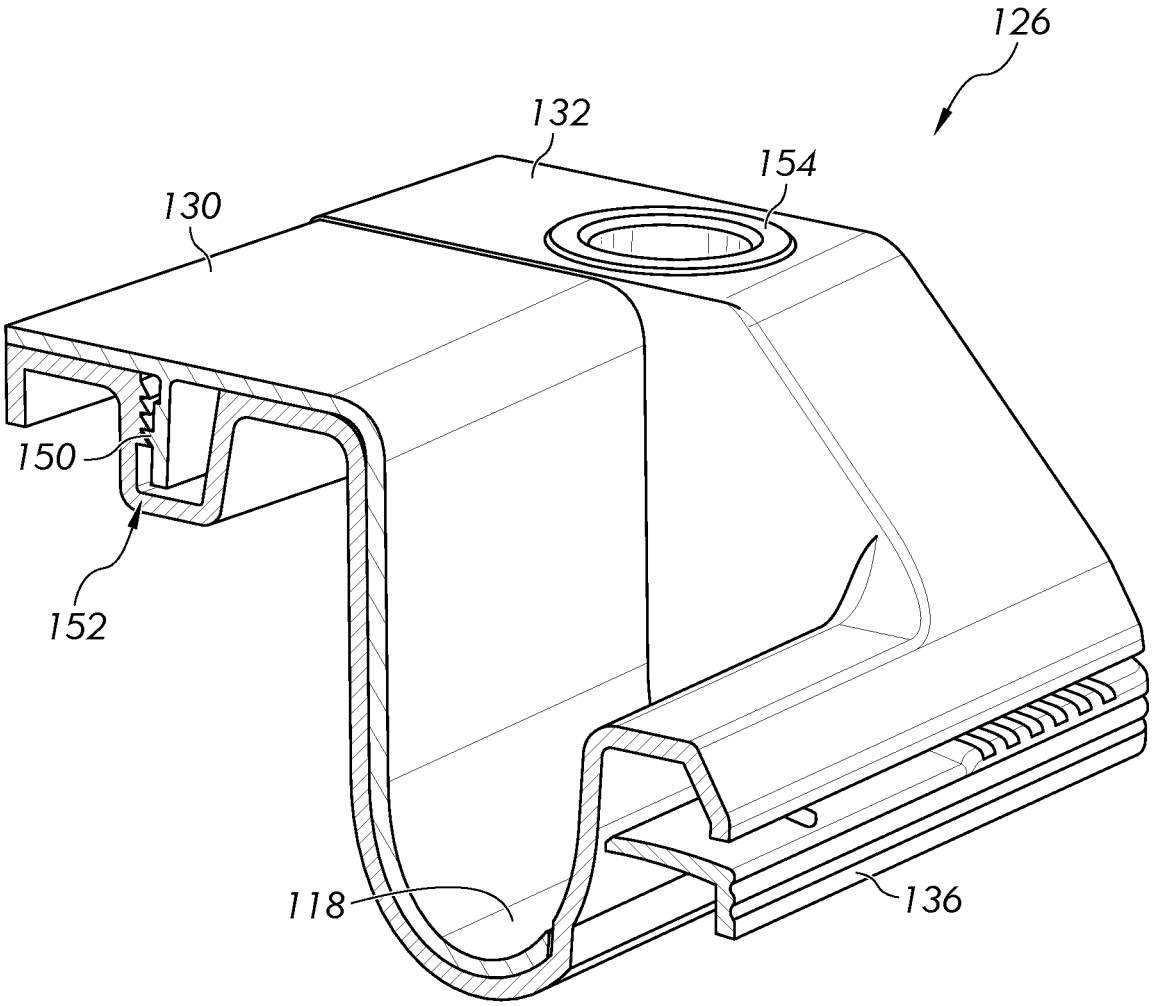
FIG. 7 is a cross-sectional view of the endcap assembly of FIG. 4 taken along the line A-A of FIG. 4.

Turning now to FIG. 7 and also still to FIG. 6, the endcap assembly 126 is shown without the front panel 120. The cover 130 is a decorative top covering coupled about an outwardly facing surface of the endcap 132. In the depicted assembly, the cover 130 at least partially defines the integrated pocket handle 118, also herein referred to as a handle recess 118. The endcap 132 and the cover 130 engage with one another, such as one of these components having a protrusion received into an orifice of the other of these components. For example, the cover 130 includes a protrusion 150 received into an orifice 152 of the endcap 132. The cover 130 can be made of metal, such as steel or aluminum, or could also be a decorative plastic, or any other suitable material. In some embodiments, the cover 130 can be omitted (wherein the endcap 132 itself provides the outward decorative surface) or can be otherwise shaped.

The endcap 132 is configured to be disposed between the cover 130 and the intermediate member 136. Generally, the endcap 132 provides a closure for a vertical end of the door 116 and extends along the lateral extent of the door 116 in a lateral direction between the side panel portions 142 (FIG. 4). The endcap 132 includes a hinge bearing 154 mounted to and extending through the endcap 132. The endcap 132 further includes a laterally-extending depression defining the handle 118. The illustrated endcap 132 can be made of any suitable material, such as plastic or metal.

Figure 8:
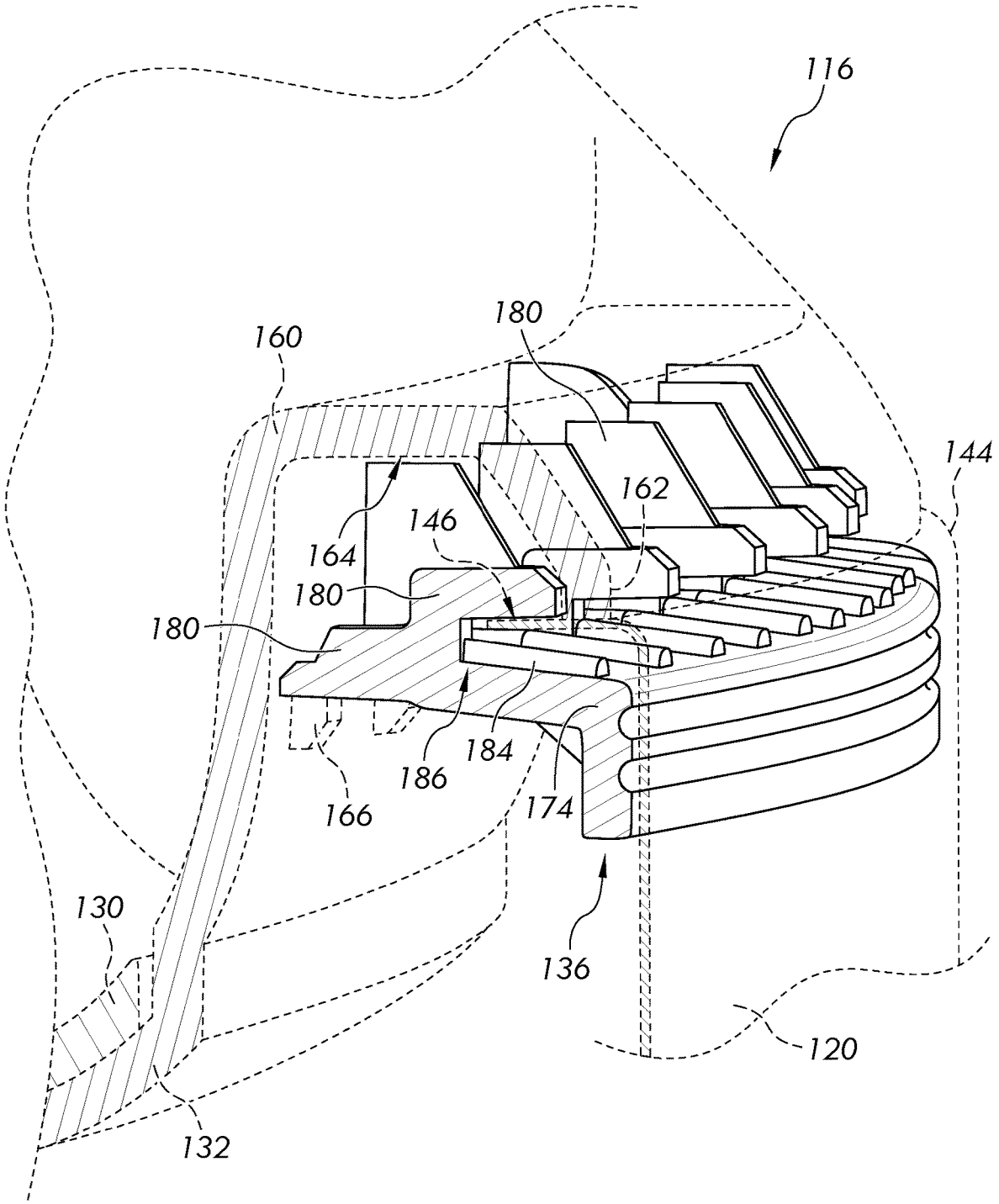
FIG. 8 is another cross-sectional, detail view of the endcap assembly of FIG. 4 taken along the line A-A of FIG. 4.
Figure 9:
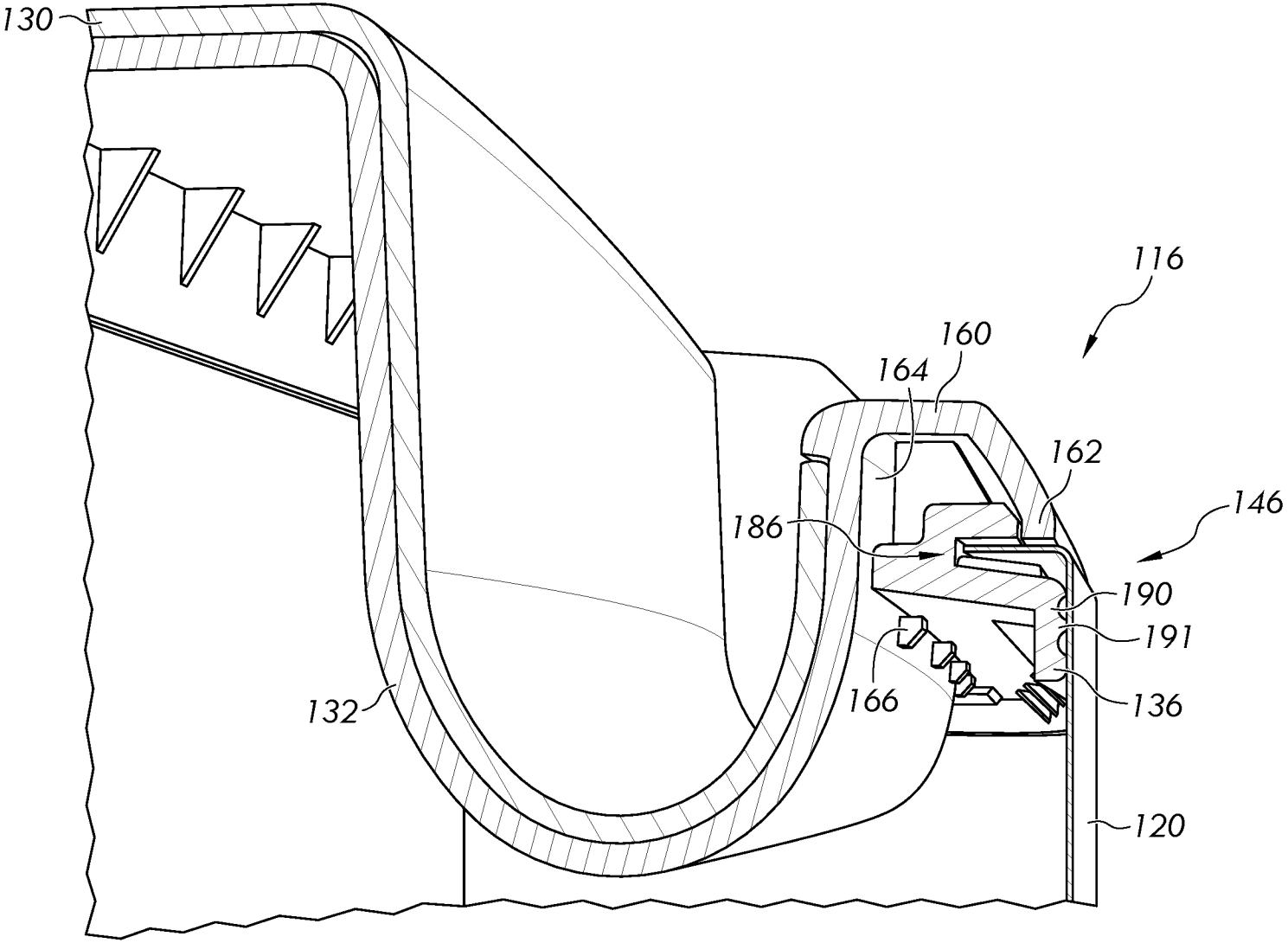
FIG. 9 is yet another cross-section view of the endcap assembly of FIG. 4 taken along the line A-A of FIG. 4.

Turning now to FIGS. 8 and 9, the endcap 132 is configured to provide an elastically-applied clamping force to retain the intermediate member 136 therewith and to retain the front panel 120 of the door at the intermediate member 136. For example, the endcap 132 includes an elastic concave portion 160 providing a downwardly facing front lip 162 at a distal end thereof at a front of the door 116. At a rear of the concavity 164 defined by the concave portion 160 are a plurality of laterally-spaced-apart protrusions 166. Each of the concave portion 160 and the protrusions 166 are configured for engaging the intermediate member 136.

The intermediate member 136 is configured to be attached to the front panel 120 and to couple together the endcap 132 and the front panel 120, by being disposed therebetween. The intermediate member 136 has a body that extends laterally along a vertical extent of the front panel 120. Returning briefly to FIG. 6, the intermediate member 136 has a generally-U-shaped body with a central portion 170 and a pair of oppositely disposed edge portions 171 and 172 extending generally orthogonally rearward from opposite sides of the central portion 170. These side portions 171 and 172 correspond with a vertical distal extent of the front panel 120 and a lower side of the endcap 132.

The central portion 170 and outer side portion 171 have a generally horizontal ledge 174, while the inner side portion 172 has a generally horizontal inner side ledge 176. The ledge 176 is vertically lower than the ledge 174 but is generally parallel therewith. This vertical distance is a result of the handle 118 defined by a recess that extends across both adjacent doors 116 to a lateral outside end at each of these doors 116. Optionally, the outer side portion 171 and the inner side portion 172 could be arranged to be vertically aligned.

Returning to FIGS. 8 and 9, and also still referring to FIG. 6 in part, a plurality of discrete spaced-apart tabs 180 extend from and forward over the generally horizontal ledges 174 and 176. A plurality of spaced-apart raised ribs 184 are disposed at the upper surfaces of the generally-horizontal ledges 174, 176. At least a portion of the raised ribs 184 are vertically disposed between the generally-horizontal ledges 174, 176 and the plurality of discrete tabs 180. The discrete spaced-apart tabs 180 and ribs 184 define a plurality of discrete snap elements, such as snap clips 186, that are spaced-apart from one another along the U-shaped body. Each snap clip 186 has a thickness along the U-shaped body that is sufficient to be suitable as a snap clip for clamping the bent, distal end 146 of the front panel 120 between the tabs 180 and the ribs 184.

As shown at FIGS. 8 and 9, when the components of the door 116 are assembled, the vertical extent of the door panel 120 is engaged between, and particularly sandwiched between, the endcap 132 and the intermediate member 136. The endcap 132 and intermediate member 136 cooperate to elastically-clamp the upper bent portion 144 of the door panel 120 therebetween. Particularly, the intermediate member 136 is securable between front and rear aspects of the endcap 132. The front aspects include the concave portion 160 that receives therein and wraps around numerous of the plurality of discrete tabs 180. The rear aspects include the plurality of protrusions 166. Thus, the intermediate member 136 and the snap clips 186 thereof are engaged between the concave portion 160 and the protrusions 166 such that the endcap 132 provides the elastic clamping force for clamping the distal end of the front panel 120. In this way, at least a portion of the snap clips 186 are configured to engage upper and lower surfaces of the bent portion 144.

When the endcap assembly 126 is assembled with the front panel 120, the front lip 162 is configured to apply a vertical retention force to the bent portion 144. Particularly, the front lip 162 abuts the bent portion 144 to at least partially define a front surface of the door, where the front lip 162 is disposed forward of the plurality of snap clips 186.

Figure 10:
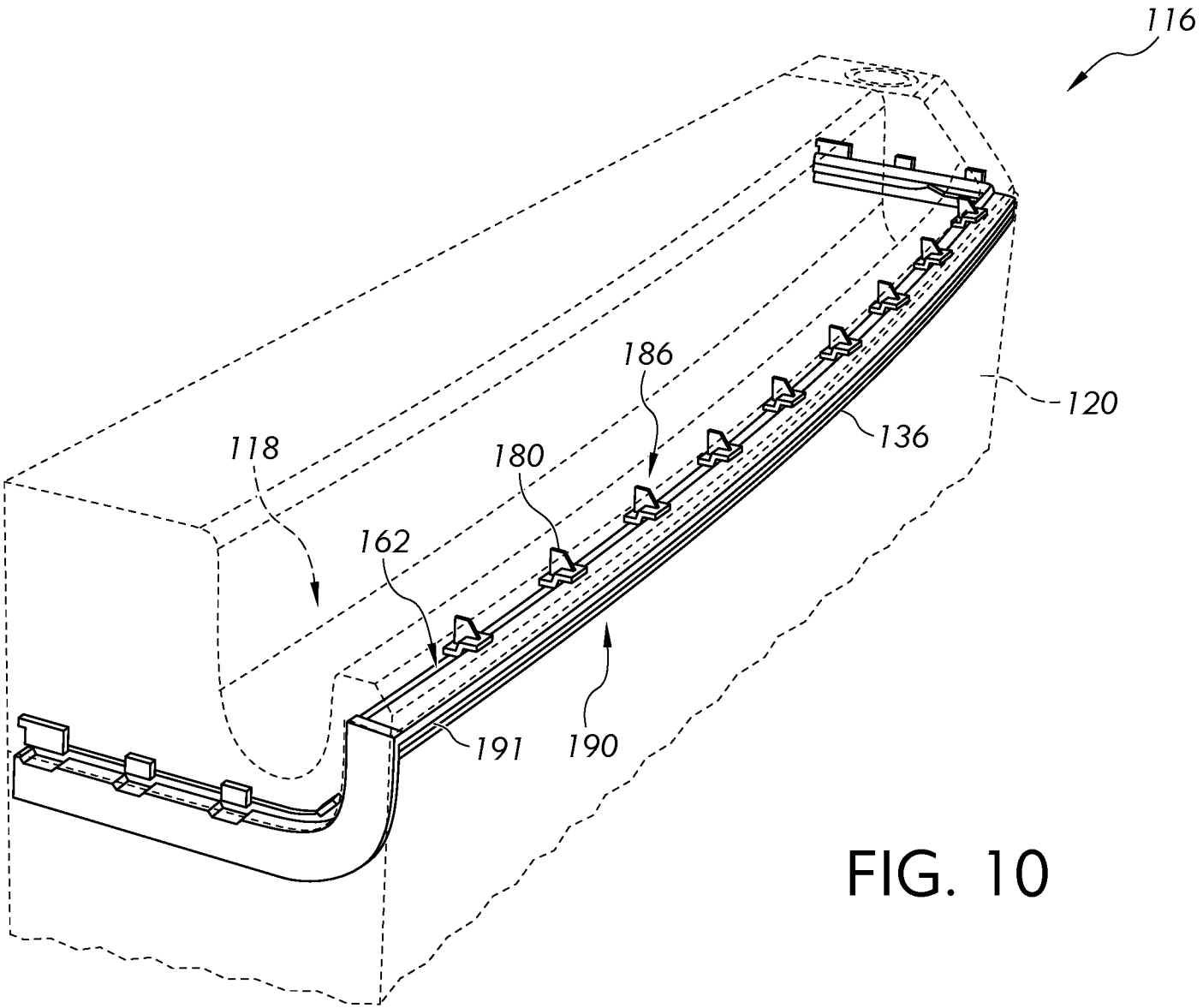
FIG. 10 is another top perspective view of the right bottom door illustrated in FIG. 4, with the endcap and front panel being shown as translucent to allow for viewing of the intermediate member in the assembled configuration of the endcap assembly.
Figure 11:
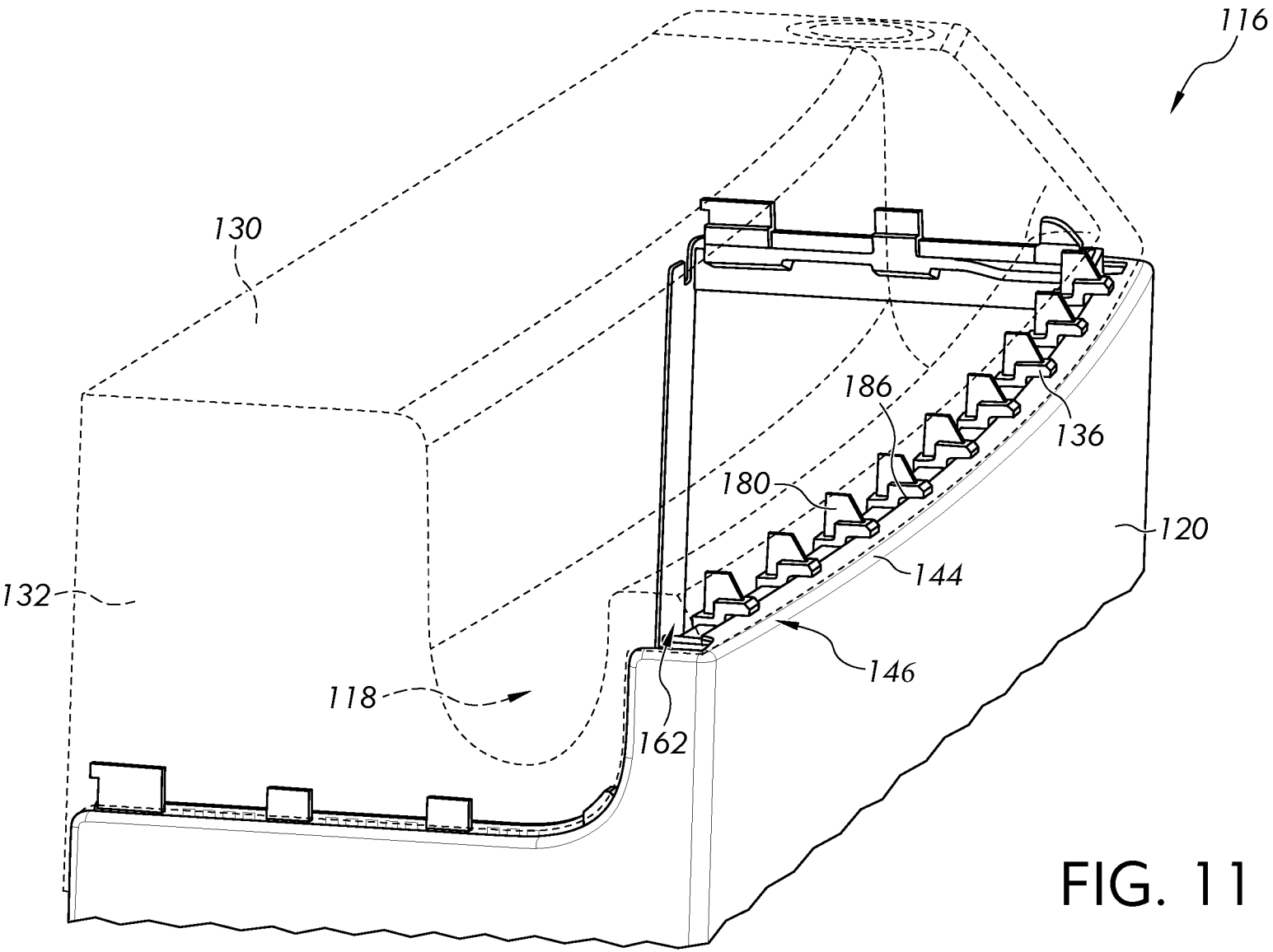
FIG. 11 is an enlarged partial view of the view of FIG. 10, with the front panel now being shown solid and only the endcap being shown as translucent.

This configuration is further illustrated at FIGS. 10 and 11. For clarity, FIG. 10 illustrates the endcap 132, cover 130 and front panel 120 as being transparent to enable viewing of normally concealed portions of the intermediate member 136. FIG. 11 illustrates the front panel 120 as opaque, concealing aspects of the intermediate member 136. As shown, the intermediate member 136 is configured to be fully concealed within the door 116 and is hidden from view behind the endcap 132 and the front panel 120.

Referring in particular to FIG. 10, the intermediate member 136 is configured to provide horizontal support to the front panel 120 at a position forward of the distal end 146 of the front panel 120. For example, the intermediate member 136 further includes a forward-facing support wall 190 having a plurality of forward-facing ridges 191 supporting the rear surface of a major portion of the front panel 120. In this way, the intermediate member 136 is configured to at least partially limit rearward disposition of the front panel 120 relative to the endcap 132.

Figure 12:
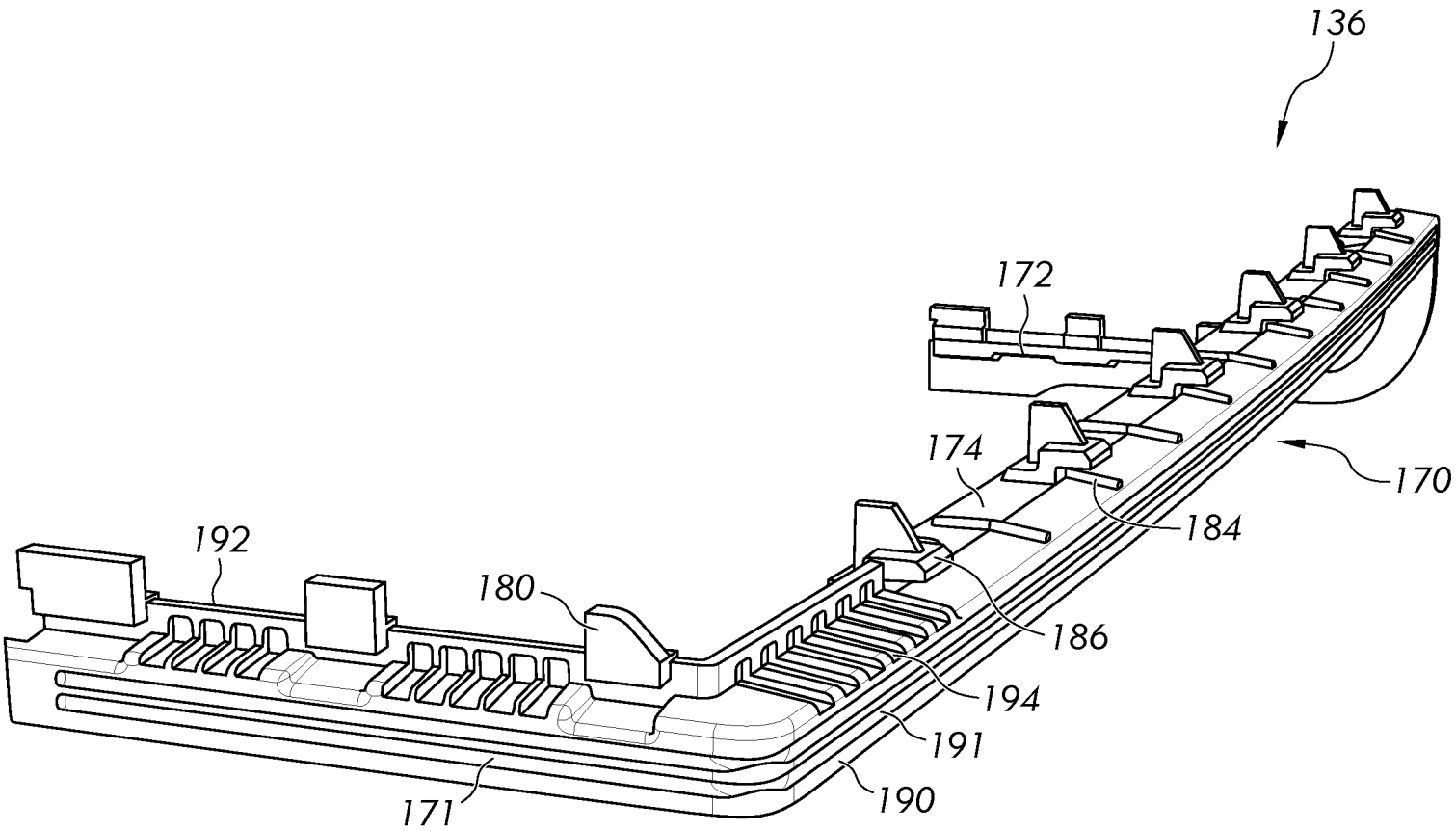
FIG. 12 is a perspective view of the intermediate member of the left bottom door of the refrigeration appliance of FIG. 3.
Figure 13:
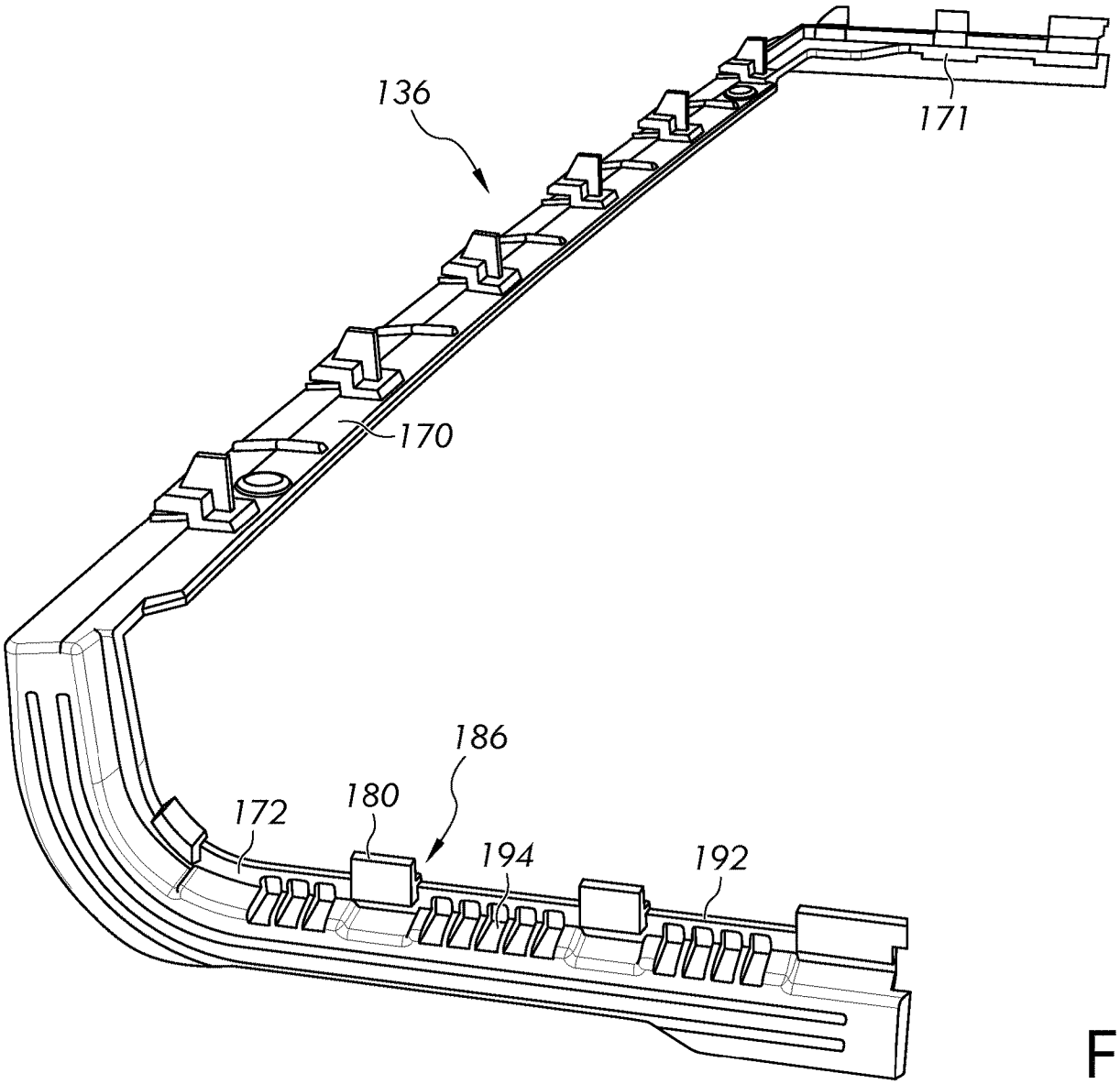
FIG. 13 is another perspective view of the intermediate member of the left bottom door of the refrigeration appliance of FIG. 3.

Looking next to FIGS. 12 and 13, the intermediate member 136 includes the U-shaped body at opposing side portions 171, 172 and at lateral extents of the central portion 170 having raised inner wall portions 192. The inner wall portions 192 each extend along the U-shaped body between a pair of discrete tabs 180. Additionally, at each of the opposite ends of the respective U-shaped body are a plurality of sets of ribs 194, which sets each are adjacent to and extend outwardly from a respective raised inner wall portion 192. The sets of ribs 194 provide for grip of the underside of the bent, distal end 146 of the front door panel 120. The raised inner wall portions 192 aid in restricting or altogether stopping inner blown expanding foam leakage to an exterior of the respective door 116 during the interior foaming manufacturing process that provides door insulation.

Figure 14:
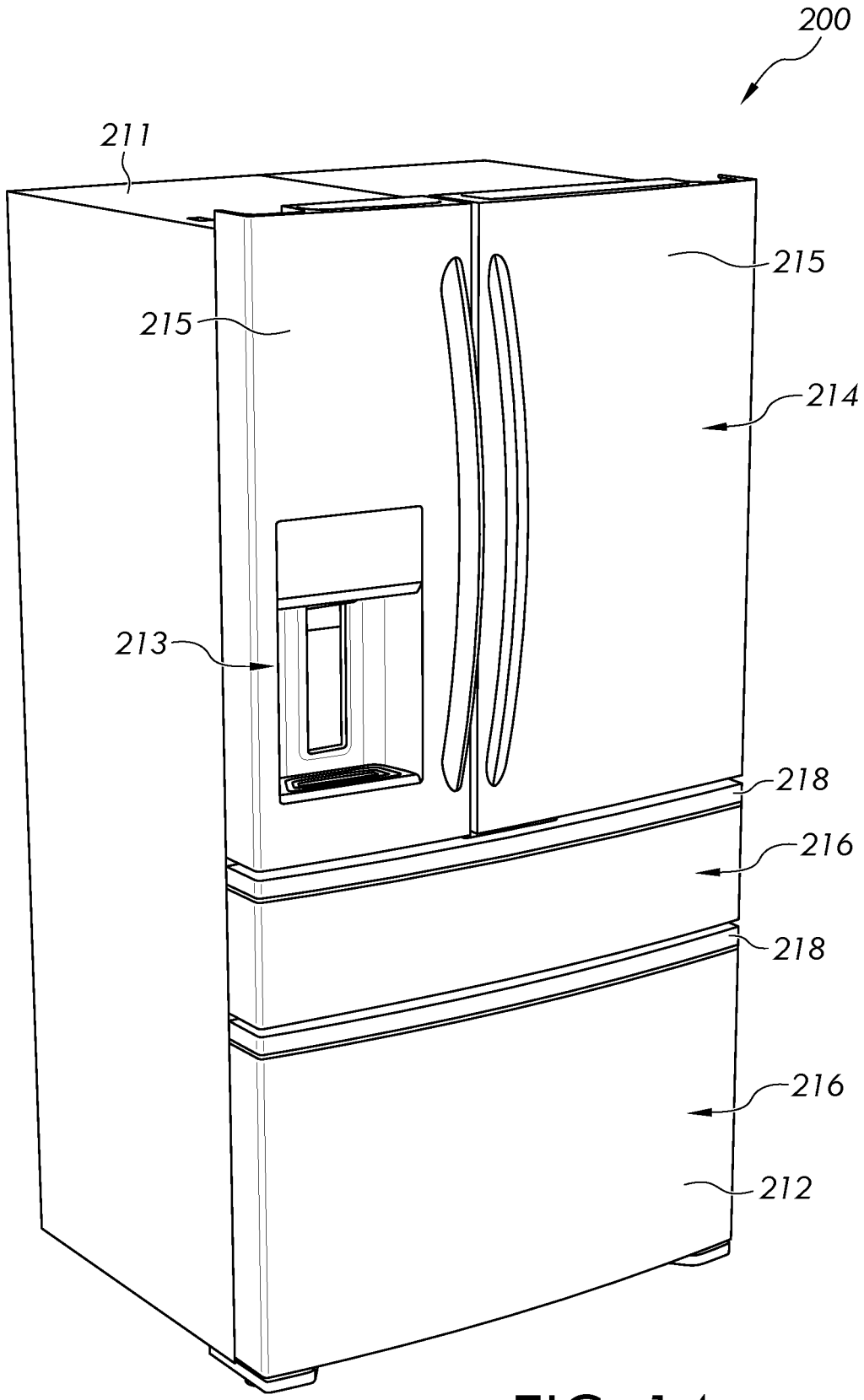
FIG. 14 is a front perspective view of a conventional household refrigeration appliance according to another embodiment and including a pair of vertically stacked drawers of a freezer compartment in a closed position.
Figure 15:
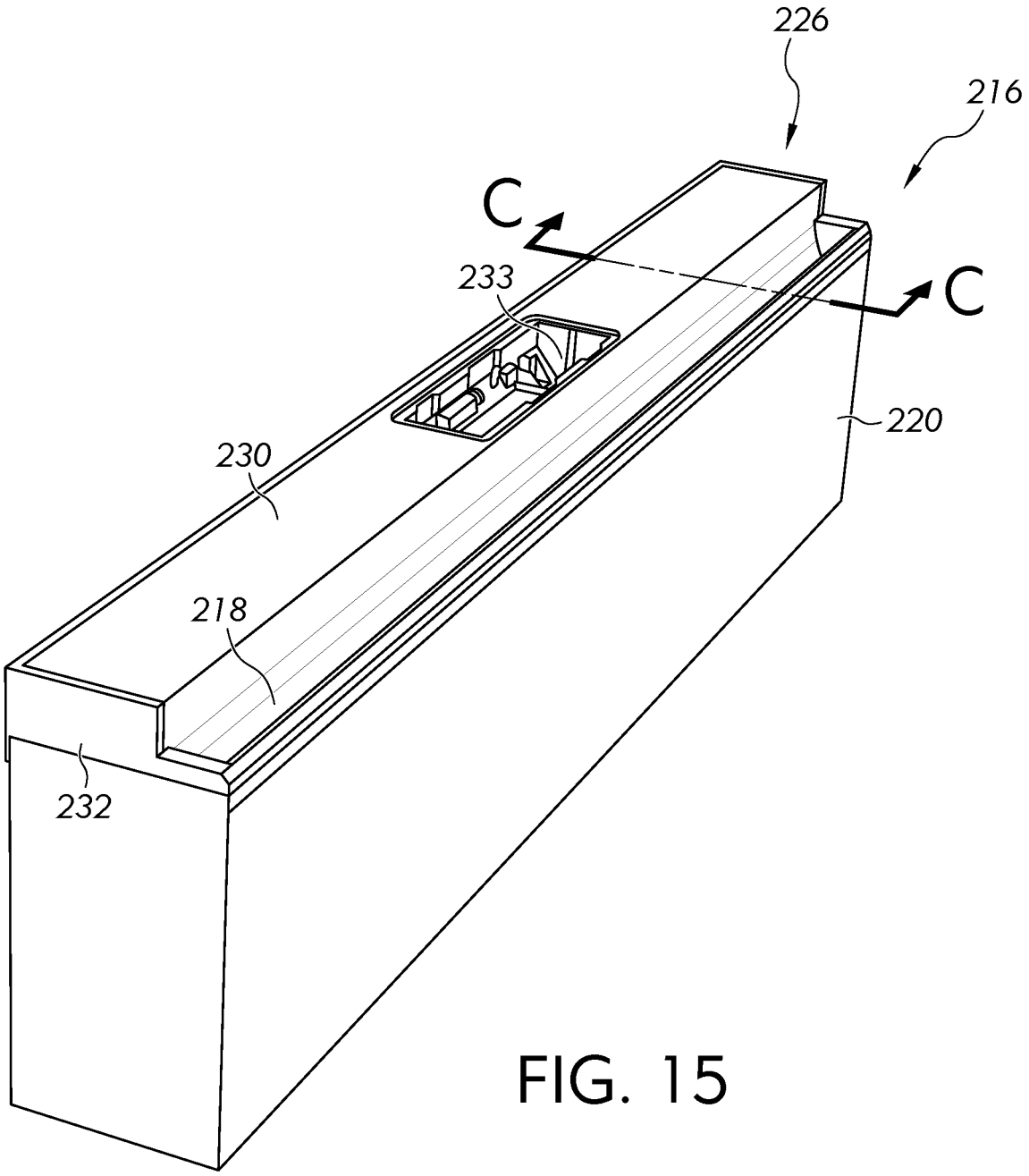
FIG. 15 is a perspective view of a pull-out drawer of the refrigeration appliance of FIG. 14, with the front panel having a generally flat front face and the respective endcap assembly having an optional depression for receiving a user interface.

Turning now to FIGS. 14 and 15, another embodiment of a refrigerator including pull-out drawers 216 is illustrated at 200. That is, the swing-door design covering the lower compartments of FIG. 3 can be replaced by one or two pull-out drawer assemblies that can be withdrawn to provide selectively access to one or two compartments. Each such compartment can either be a freezer or a VCZ compartment, and each drawer 216 is provided for sealing a compartment of a respective refrigerator. The construction of the drawer 216 is substantially similar to the door 116 discussed above, and also has a vertically-upper endcap assembly 226, and as otherwise discussed below. Aspects of the drawer 216 that are similar to aspects of the door 116 are identified with the same reference numbers but indexed by 100. It will be appreciated that aspects of the door 116 may be incorporated into the drawer 216 and vice versa. It is to be appreciated that as described herein, a drawer is considered to be one type of a door, and the terms can be used interchangeably.

Similar to the refrigerator 100, the refrigerator 200 includes a body 211 defining a lower freezer compartment 212 and an upper fresh food compartment 214. The fresh food compartment is closed by a pair of hinged doors 215. The freezer compartment 112 includes the pair of drawers 216. Preferably, one of the hinged doors 215 includes a dispenser 213, such as for water, ice, or both. Preferably, each of the drawers 216 includes a recessed handle 218 integrated with the respective drawer 216.

Figure 16:
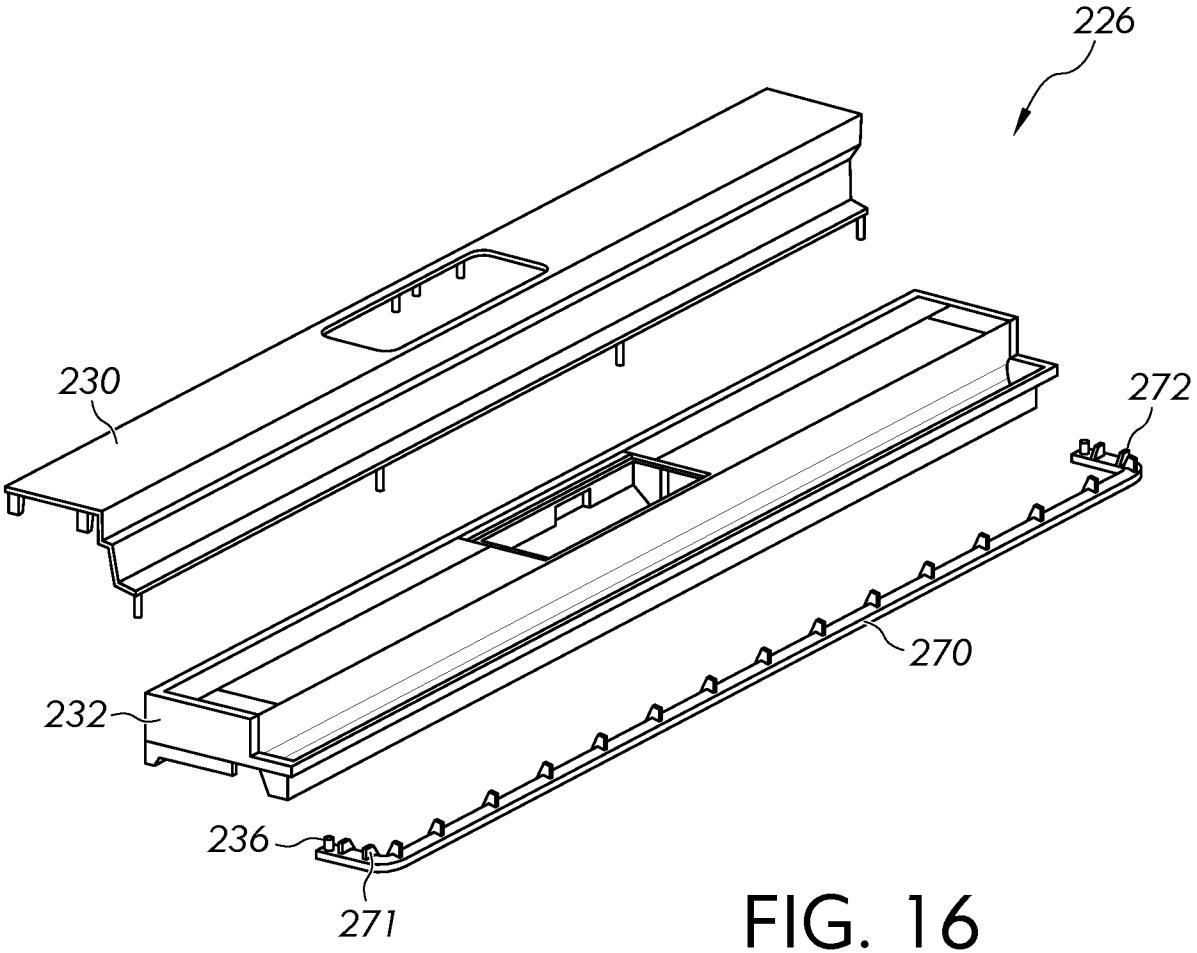
FIG. 16 is an exploded view of the endcap assembly of FIG. 15.

The drawer 216 has a front panel 220 with a flat front surface, although it could have an arched surface as depicted in the other embodiments herein. Turning to FIG. 16, the endcap assembly 226 includes a cover 230, endcap 232 and intermediate member 236. The cover 230 and endcap 232 are configured to receive a user interface at the upper side of the drawer 216, such as at the cutout 233. While not particularly shown, in some embodiments, the endcap assembly 226 can include a hinge bearing, and in other embodiments, the endcap assembly 226 can be included in a drawer assembly. The cover 230 could be optionally removed, whereby the endcap 232 is the decorative outer surface.

Figure 17:
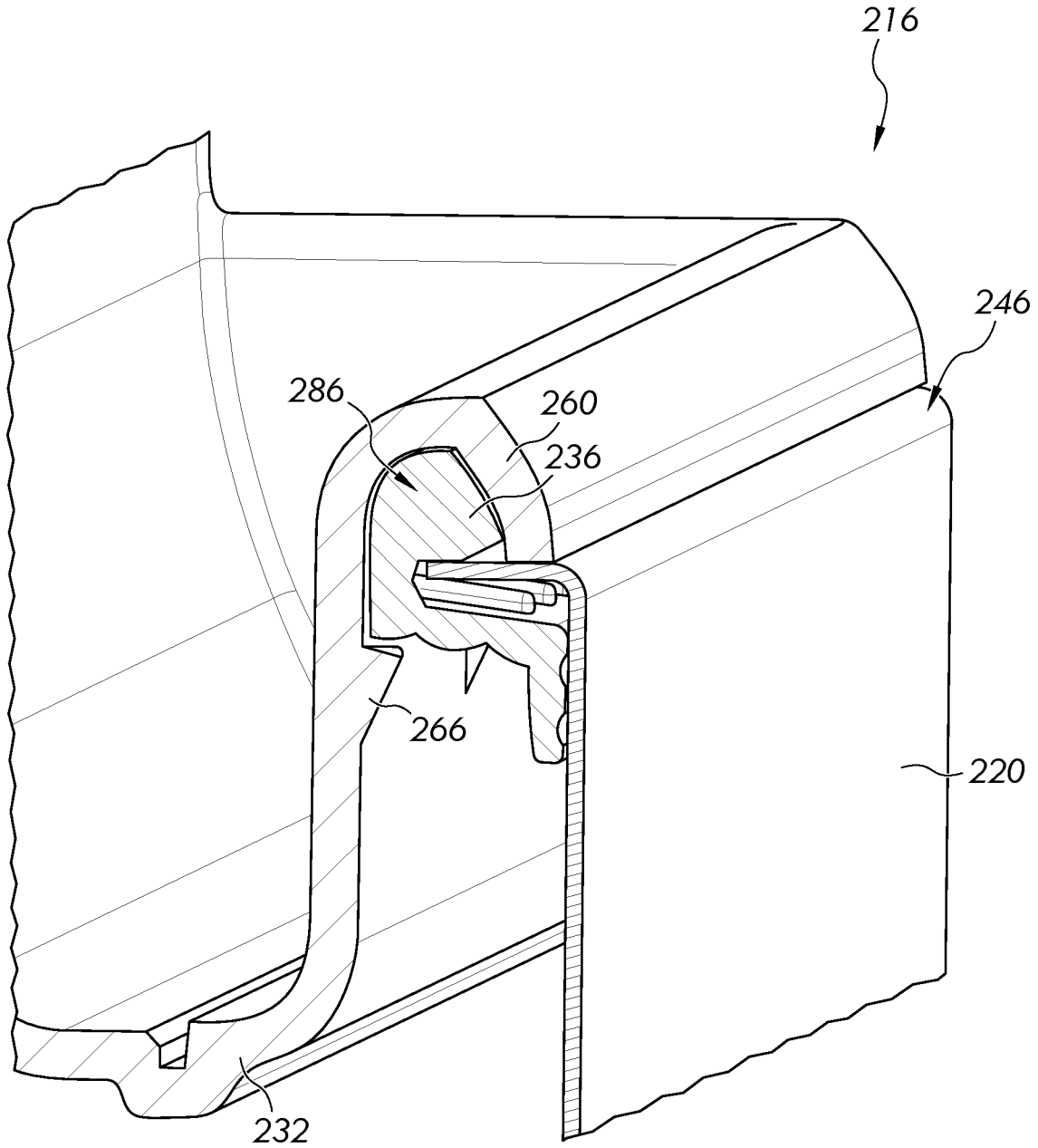
FIG. 17 is a cross-sectional view of the endcap assembly of FIG. 15 taken along the line C-C of FIG. 15.
Figure 18:
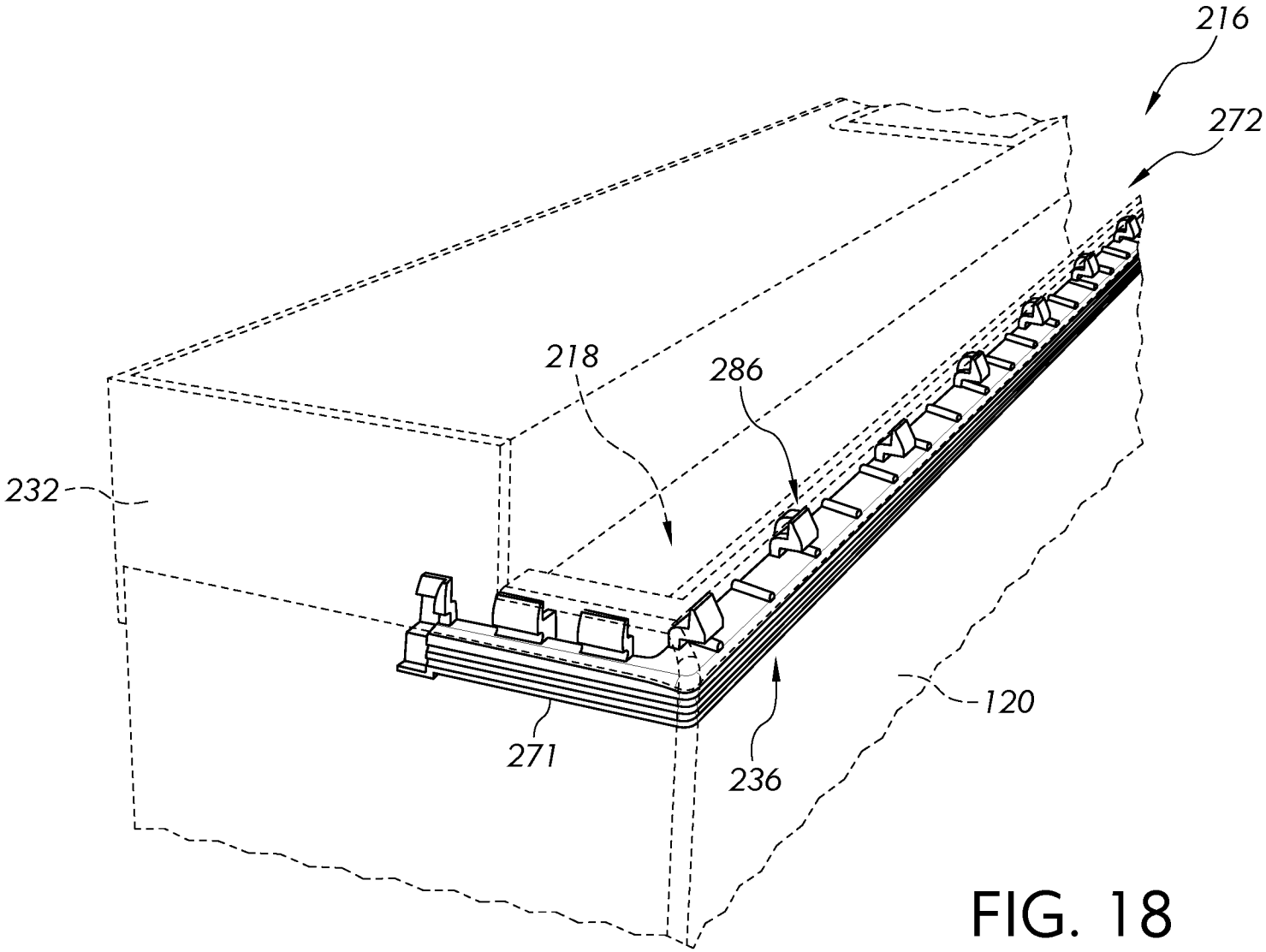
FIG. 18 is a top perspective view of the right bottom drawer illustrated in FIG. 15, with the endcap and front panel being shown as translucent to allow for viewing of the intermediate member in the assembled configuration of the endcap assembly.

As depicted at FIG. 17, and similar to the endcap assembly 126, the intermediate member 236 is secured by the concave portion 260 of the endcap 232 to thereby elastically clamp the distal end 246 of the door panel 220 at discrete snap clips 286, in a similar fashion as previously described herein with reference to FIGS. 8-11. For example, in a short and non-limiting summary, when the components of the drawer 216 are assembled, the vertical extent of the door panel 220 is engaged between, and particularly sandwiched between, the endcap 232 and the intermediate member 236. The endcap 232 and intermediate member 236 cooperate to elastically-clamp the upper bent distal end 246 of the door panel 220 therebetween. Thus, the intermediate member 236 and the snap clips 286 thereof are engaged between the concave portion 260 and the protrusions 266 such that the endcap 232 provides the elastic clamping force for clamping the distal end of the front panel 220. At FIG. 18, the cover 230, endcap 232 and front panel 220 are shown as transparent at FIG. 18 for clarity. Similar to the endcap assembly 126, the endcap assembly 226 includes the intermediate member 236 being hidden by the endcap 232 and front panel 220. Different from the endcap assembly 126, the opposing sides 271 and 272 (FIG. 16) of the U-shaped body of the intermediate member 236 are horizontally parallel to one another and lack inner wall portions and sets of ribs, although the opposing sides 271 and 272 could also be vertically mis-aligned.

In summary, a refrigeration appliance 100 includes a compartment 112, 114, 212, 214 for storing food items in a refrigerated environment and having a door or drawer 116, 216 for selectively closing the compartment 112, 114, 212, 214. The door or drawer 116, 216 includes a front panel 120, 220, a rear panel 122, 222, and an endcap assembly 126, 226 disposed therebetween at a vertical end thereof. The endcap assembly 126, 226 defines a recessed handle 118, 218 for allowing grip of the door or drawer 116, 216 to thereby selectively open and close the door or drawer 116, 216. The endcap assembly 126, 226 includes a plurality of discrete, spaced-apart snap clips 186, 286 along a generally front portion thereof for clamping a distal end 146, 246 of the front panel 120, 220 at a generally vertical extent of the front panel 120, 220. The endcap assembly 126, 226 and front panel 120, 220 are configured to be maintained aside one another rather than extending therethrough, with the endcap assembly 126, 226 further configured to provide an elastic clamping force to the distal end 146, 246 of the front panel 120, 220.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

The invention claimed is:

1. A door for sealing an internal compartment of a refrigeration appliance, the door comprising:

a front panel defining an exterior front surface of the door;

an endcap defining a handle for allowing grip of the door and providing closure for a vertical end of the door; and an intermediate member disposed between the endcap and the front panel and that secures the endcap to the front panel, the intermediate member extending along an upper vertical extent of the front panel, wherein the intermediate member has a plurality of discrete snap elements spaced-apart along an extent of the intermediate member for clamping a distal edge of the front panel, and wherein the endcap is configured to provide an elastically-applied clamping force to retain the intermediate member therewith and to retain the front panel at the intermediate member.

2. The door of claim 1, wherein the endcap has an elastic concave portion that wraps around the plurality of snap elements of the intermediate member to retain the intermediate member therewith.

3. The door of claim 1, wherein an edge at the upper vertical extent of the front panel is clamped between the endcap and the intermediate member.

4. The door of claim 1, wherein the intermediate member includes a plurality of forward-facing ridges supporting a rear surface of a major portion of the front panel.

5. The door of claim 1, further including a cover member coupled about an outwardly facing surface of the endcap.

6. The door of claim 1, wherein the door is internally-foamed to aid in retaining the endcap and the front panel in position relative to one another.

7. The door of claim 1, wherein the intermediate member is disposed fully hidden from view behind the endcap and the front panel.

8. The door of claim 1, wherein the door is pivotably connectable by a hinge to a body of the refrigeration appliance.

9. The door of claim 1, further including a hinge bearing mounted to and extending through the endcap.

10. A door for sealing an internal compartment of a refrigeration appliance, the door comprising:

a front panel and a rear panel, the front panel for defining a front surface and side portions of the door; and an endcap assembly extending between the front panel and the rear panel and sealing a vertically upper or lower end of the door, the endcap assembly including:

an endcap defining a depression extending generally horizontally along a portion of the front surface of the front panel, and a generally U-shaped intermediate member having a central portion and a pair of oppositely disposed edge portions extending generally orthogonally rearward from opposite sides of the central portion and corresponding with a distal extent of the front panel, the intermediate member being disposed between and coupling together the endcap and the front panel, wherein the endcap has a concave extension that extends laterally along the front panel and wraps around the intermediate member to a front lip disposed at the central portion and adjacent a top surface of a bent portion at a distal end of the front panel being bent out of plane from the front surface of the front panel.

11. The door of claim 10, wherein the intermediate member includes a plurality of snap clips spaced apart along the central portion and the pair of oppositely disposed edge portions, the plurality of snap clips engaging upper and lower surfaces of the bent portion.

12. The door of claim 11, wherein the front lip is disposed forward of the plurality of snap clips.

13. The door of claim 10, wherein the endcap is configured such that the front lip applies a vertical retention force to the bent portion.

14. The door of claim 10, wherein the front lip abuts the bent portion to define a front surface of the door.

15. The door of claim 10, wherein the intermediate member is configured to provide horizontal support to the front panel at a position forward of the distal end of the front panel.

16. The door of claim 10, wherein the endcap includes a plurality of laterally-spaced-apart protrusions engaging an underside of the intermediate member disposed opposite a surface engaged by the bent portion, and wherein the intermediate member is clamped by the endcap between the plurality of laterally-spaced-apart protrusions and the front lip.

17. An endcap assembly for sealing and defining a vertical end of a compartment sealing-body of a refrigeration appliance, the endcap assembly comprising:

an endcap having a depression defining a handle for a user; and an intermediate member securable between front and rear aspects of the endcap, the intermediate member for securing a front panel of the compartment sealing-body to the endcap;

the intermediate member including:

a generally-horizontal ledge, a plurality of discrete tabs extending from and forward over the generally-horizontal ledge, and a plurality of spaced-apart raised ribs at the generally-horizontal ledge, and at least a portion of the plurality of spaced-apart raised ribs being vertically disposed between the generally-horizontal ledge and the plurality of discrete tabs, wherein front aspects of the endcap include a concave extent receiving the plurality of discrete tabs therein and providing an elastic clamping force between the plurality of discrete tabs and the plurality of spaced-apart raised ribs for clamping a distal edge of the front panel.

18. The endcap assembly of claim 17, wherein the intermediate member further includes a forward-facing support wall for limiting rearward disposition of the front panel relative to the endcap.

19. The endcap assembly of claim 17, wherein the intermediate member is shaped to extend along a front and opposing sides of the front panel.

20. The endcap assembly of claim 19, wherein the intermediate member includes a laterally-extending central portion and opposing side portions vertically-extending therefrom, and wherein the opposing side portions each include raised inner wall portions each extending between a pair of discrete tabs and configured to restrict inner blown foam leakage to an exterior of the compartment sealing-body.

* * * * *